United States Patent [19]

Butcher et al.

[11] Patent Number: 4,463,784

[45] Date of Patent: Aug. 7, 1984

[54] VALVE ASSEMBLY FOR PRESSURIZED DISPENSERS

[75] Inventors: Roger A. Butcher, Horndean, England; Andre Debard, Buc, France

[73] Assignee: Aerosol Inventions and Development S.A. AIDSA, Fribourg, Switzerland

[21] Appl. No.: 355,342

[22] Filed: Mar. 8, 1982

[30] Foreign Application Priority Data

Mar. 7, 1981 [GB] United Kingdom ..... 8107238
Mar. 30, 1981 [FR] France ..... 81 06273

[51] Int. Cl.[3] ..... B65B 31/00
[52] U.S. Cl. ..... 141/20; 222/402.16
[58] Field of Search ..... 141/3, 20; 222/402.16

[56] References Cited

U.S. PATENT DOCUMENTS 3,122,180 2/1964 Abtlanalp ..... 141/3
3,160,182 12/1964 O'Donnell ..... 141/20
3,319,669 5/1967 Abtlanalp ..... 141/20
3,404,863 10/1968 Green ..... 222/402.16
3,738,542 6/1983 Ruscith ..... 141/20
4,247,024 1/1981 Vogel ..... 222/402.16
4,271,875 6/1981 Meshberg ..... 141/3

*Primary Examiner*—Stephen Marcus
*Assistant Examiner*—Ernest G. Cusick
*Attorney, Agent, or Firm*—Scrivener, Clarke, Scrivener and Johnson

[57] ABSTRACT

In a valve assembly for a pressurized dispenser, such as of the kind commonly known as aerosol cans, a novel arrangement is proposed for sealing the spray tip or button to the ferrule or center boss of the mounting cup of the valve during 'gassing'. An inwardly directed annular shoulder formed in the top wall of the ferrule or center boss is engaged by an outwardly facing annular surface on the underside of the spray tip and the higher the pressure the better the seal. As the spray tip no longer needs to be as flexible as hitherto it can be made of polypropylene. A complementary outward-facing shoulder on the underside of the top wall helps to locate the rim of the valve shell and thereby to resist displacement of the gasket during gassing.

4 Claims, 3 Drawing Figures

VALVE ASSEMBLY FOR PRESSURIZED DISPENSERS

SPECIFIC DESCRIPTION

This invention relates to the construction of valve assemblies for pressurised dispensers, for example of the kind commonly known as aerosol dispensers.

One of the known ways of filling the necessary propellant gas into a pressurised dispensing container is to bring a so-called gassing head into sealing engagement with the valve mounting cup and to pass the propellant gas under high pressure through the valve itself. This can be done before the usual spray tip or button (which usually has a very restricted outlet orifice) is fitted, but for practical commercial reasons it is desirable to be able to pass the gas into the container after the spray tip has been fitted. In a U.S. Pat. No. 3,122,180, now expired, there is disclosed a method in which openings extend vertically through the spray tip itself and the underside of the spray tip has a peripheral skirt which seals onto the central boss of the valve mounting cup as the gassing head engages the spray tip, pushing it down onto that central boss.

In some known systems, including the one described above, the gas does not pass through the internal metering orifice of the valve (which would severely restrict the permissible rate of flow) but flows above or below, or both above and below, the usual annular rubber gasket of the valve and thence directly into the container.

A drawback of the system described above, and of other systems in which the gassing head seals directly or indirectly onto the outside of the control boss of the mounting cup, is that the gas pressure, which is very high, is acting in a direction that tends to break the seal, and so despite high engaging forces there can often be substantial leakage. A further drawback is the restriction imposed on the freedom of design of the button by the fact that the diameter of the button has to be at least as big as that of the boss.

It is also known to provide a separate collar of plastics material around the centre boss of the mounting cap, solely for the purpose of forming a seal with the gassing head but this adds to the cost as well as detracting from the appearance of the valve during subsequent use.

The very high filling speeds now demanded, of the order of 180 gm of the propellant per second, result in severe distortion and possible bodily displacement of the gasket of the valve during filling unless it is securely held, yet it cannot be completely restricted since the path of the propellant is formed by deflecting the gasket. The problem arises particularly where the valve has been held in stock for a long time before it is fitted to a container and subjected to the filling loads.

The primary aim of the present invention is to keep leakage during gassing to a minimum, a further aim being to keep the gassing path as free as possible. A still further aim is to ensure correct and secure location of the gasket.

According to the invention we propose that the top wall of the center boss of the mounting cup, or the top wall of the mounting ferrule (for example in a bottle valve) should be recessed to define an inwardly facing annular shoulder and the underside of the spray tip or button should have an outwardly directed annular surface designed to co-operate with the shoulder to form a seal during gassing.

As the shoulder on the mounting cup or ferrule faces inwards and the co-operating surface on the spray tip faces outwards the internal pressure within the spray tip and around the valve stem is acting in a direction to increase, rather than oppose, the sealing action.

Preferably the stem of the valve has a portion of reduced diameter above that portion of it which lies within the top wall of the center boss or ferrule in the rest position, so that when the spray tip and stem are depressed during gassing, this reduced-diameter portion comes opposite the top wall and provides additional clearance around the stem for the incoming gas.

The inwardly facing shoulder on the upper face of the top wall of the boss or ferrule is accompanied by an outwardly facing shoulder on the underside of the same wall. Preferably this engages inside the upper rim of the valve shell and assists in locating that shell, and thereby locating the gasket that fits into the upper end of the shell, laterally in relation to the boss or ferrule.

The invention will now be further described by way of example with reference to the accompanying drawings in which.

Figure 1:
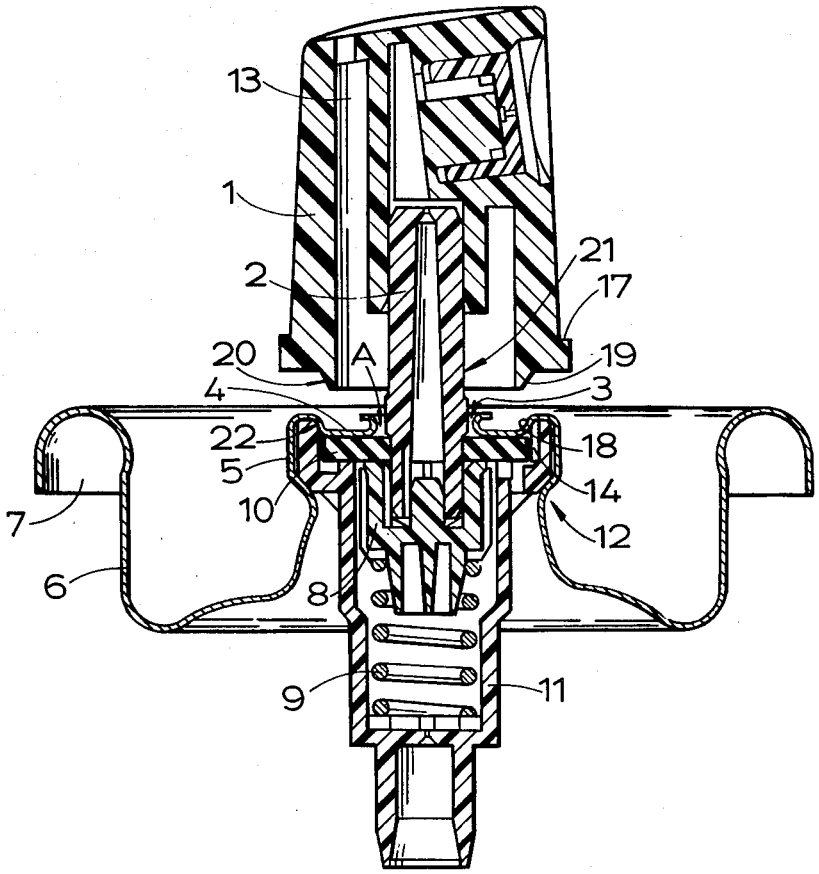
FIG. 1 is a vertical section through a valve assembly in its rest position.

The valve assembly is basically of known construction, comprising a spray tip 1 fitting onto a hollow stem 2 which passes through a hole 3 in the top wall 4 of the center boss 5 of a sheet metal mounting cup 6, the rim 7 of which is designed to be crimped onto a standard opening in an aerosol can (not shown). The lower end of the stem 2 engages in a cup-shaped valve member 8 which, in the closed position, is urged by a spring 9 against the underside of a disc-like synthetic rubber gasket 10. The valve member and spring 9 are contained within a shell 11 secured into the center boss 5 by crimping of the latter at 12.

As so far described, the valve assembly is orthodox. Also in a known manner the spray tip 1 has at least one vertical passage 13 extending through it, by which propellant gas can be passed down through the spray tip and through the clearance between the outside of the stem 2 and the hole 3 in the top wall 4 of the centre boss, and thence radially outwards past the gasket 10 (above and/or below it) to enter the interior of the container (not shown) on which the valve is mounted, around the outside of the shell 11 without passing through the stem 2 and valve member 8. The path of the gas is indicated by the arrows in FIG. 2. It goes mainly above the gasket, which is compressed or flattened by the extremely high gassing pressure to provide the space seen in FIG. 2 for gas flow between the gasket and the inner face of the top wall. The gas then passes through notches 14 in the rim of the shell 11, direct to the interior of the container, but some may also pass between the stem and gasket and thence through the valve shell and the dip tube (not shown) on its lower end.

Figure 2:
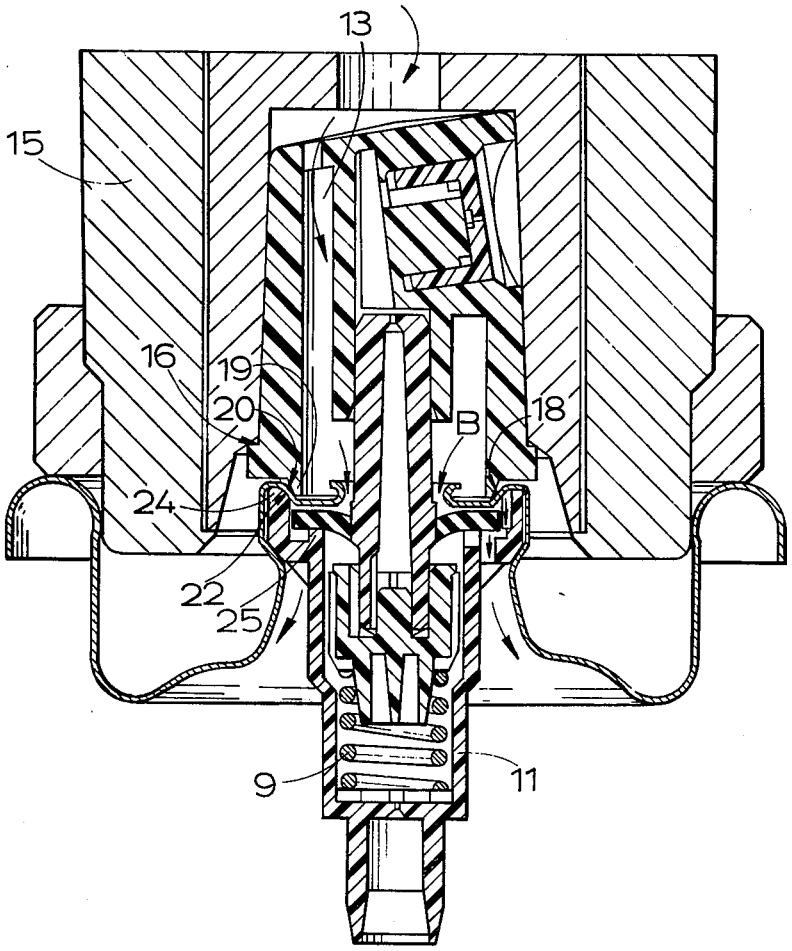
FIG. 2 shows the valve asembly of FIG. 1 engaged by a gassing head and showing the position its parts occupy during gassing.

For this purpose of gassing it is necessary to seal the gassing head, shown in FIG. 2 at 15, to the spray tip and to seal the spray tip to the mounting cup. The first of these seals is achieved by a shoulder 16 on the head, engaging a flange 17 on the outside of the spray tip. To form the second seal, according to the present invention we recess the top wall 4 of the center boss 5, to define an inwardly facing frusto-conical annular shoulder 18, and on the underside of the spray tip 1 we provide a downwardly projecting annular flange 19, of which the outwardly facing frusto-conical surface 20 engages the surface of the shoulder 18.

As in the known arrangement shown in the expired U.S. Pat. No. 3,122,180, it is the gassing head itself which presses the spray tip 1 down onto the center boss 5. However, in the arrangement according to the present invention, in contrast to the known arrangement, the high pressure prevailing within the spray tip and around the stem during gassing presses outwards on the flange 19, urging it tightly against the shoulder 18, to ensure a good seal, with the minimum of leakage; the higher the pressure, the better the sealing.

Whereas in the known arrangement, sealing onto the outside diameter of the mounting boss, it was necessary to use a relatively flexible material such as polyethylene for the spray tip, we are no longer restricted in this way and we are enabled to use a material of lower cost, for example polypropylene.

It will also be noted that, whereas there is a relatively small clearance A (FIG. 1) between the outside of the stem 1 and the inside rim of the top wall in the rest position of the valve, this clearance is substantially increased (see B in FIG. 2) during gassing by virtue of the reduction in diameter of the upper part of the stem, shown at 21. This helps to keep down the resistance to flow and thereby to speed up the gassing process.

The provision of the recess in the top wall 4 of the center boss 5 to define the inwardly facing shoulder 18 results also in the formation of an outwardly facing annular shoulder 22 on the underside of that same top wall. The upper rim of the shell 11 of the valve assembly is held against the underside of this top wall by crimping of the center boss in a generally known manner, and the rim of the shell is located on the outside by the downwardly extending outside wall of the centre boss. However in the construction according to the invention it is located at the inside as well, by the presence of the shoulder 22, which is placed so as to engage this rim tightly. The gasket 10 is engaged at its periphery by the rim of the shell and so, through the medium of the shell, the gasket is accurately and firmly located in relation to the hole 3 through which the stem 2 protrudes.

Figure 3:
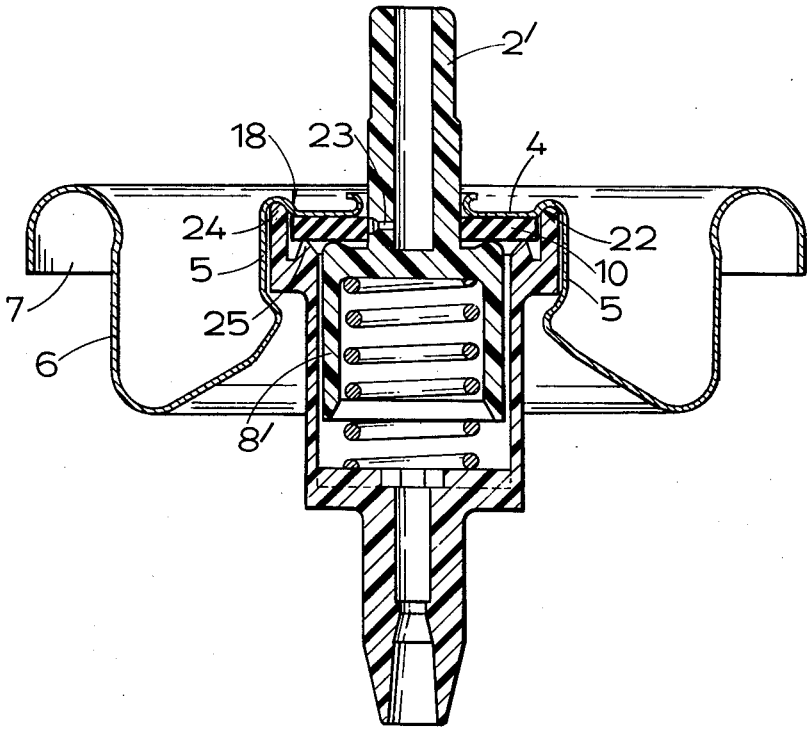
FIG. 3 is a view similar to FIG. 1, showing the invention applied to an alternative form of valve assembly, but in this case the button is not shown.

FIG. 3 shows an alternative construction of valve in which, in a manner well-known in itself, the valve stem shown at 2', and the valve member, shown at 8', are made in one piece, the interior of the stem communicating with the interior of the valve shell (when the valve is open) through a radial hole 23.

Both in the valve of FIGS. 1 and 2 and also in that of FIG. 3, the upper rim of the valve shell not only locates the gasket laterally but also, again in co-operation with the top wall 4 of the center boss 5, controls the degree of compression of the gasket, substantially regardless of the degree of crimping applied to the side wall of the boss 5. This is a consequence of the construction of the rim, by which an outer rim portion 24 abuts against the outer part of the top wall 4 and an inner rim portion 25 engages the underside of the gasket and holds it against the underside of the inner part of the top wall 4. This ensures consistency of behavior of the valves under mass-production manufacturing conditions and with a minimum risk of displacement during gassing, despite possible long periods in stock before use.

What we claim is:

1. In a valve assembly for a pressurized dispenser, said assembly comprising a mounting member a center boss on said mounting member, said boss having a top wall with inner and outer faces and a side wall, a sealing gasket within said boss and engaging the inner face of said top wall, a hollow valve shell within said boss and having an open upper end surrounded by a rim having inner and outer sides, said shell being secured within said boss, a valve member within said shell, spring means urging said valve member into engagement with said gasket, a valve stem having therein an outlet path, said stem being connected to said valve member and having a portion protruding through said gasket and top wall, a dispensing tip mounted on the protruding portion of said stem and having an underside facing the outer face of said top wall, and a fluid passage through said tip opening into the underside thereof for the delivery of gassing fluid to said dispenser; the improvement comprising an annular shoulder having an inwardly facing annular surface on the outer face of said top wall, and surrounding said stem, and an annular flange having an outwardly facing annular surface on said underside of said dispensing tip outwardly of the opening of said fluid passage to said underside, said shoulder and flange surfaces making substantially fluid tight engagement when said tip is urged into contact with said top wall against the action of said spring means, said flange surface being arranged to be urged outwardly against said shoulder surface to increase said fluid tight engagement in response to pressure of gassing fluid delivered through said fluid passage to said underside of said tip.

2. In the valve assembly set forth in claim 1 including further an annular outwardly facing shoulder on the inner face of said top wall, complementary to said inwardly facing shoulder on the outer face and engaging the inner side of said rim of said shell, thereby locating said rim.

3. In the valve assembly of claim 2 wherein said shoulders are defined by an annular deformation in the top wall of said centre boss.

4. In the valve assembly set forth in claim 1 wherein said shoulder and said flange surfaces are both of frusto-conical form.

* * * * *